United States Patent [19]

Elgin

[11] 4,039,166

[45] Aug. 2, 1977

[54] STAMPED METAL FENCE POST CAP

[75] Inventor: Robert J. Elgin, Penn Township, Westmoreland County, Pa.

[73] Assignee: United States Steel Corporation, Pittsburgh, Pa.

[21] Appl. No.: 635,496

[22] Filed: Nov. 26, 1975

[51] Int. Cl.[2] ..... E04H 17/14
[52] U.S. Cl. ..... 256/65
[58] Field of Search ..... 256/59, 65, 24, DIG. 5; 52/752, 300, 301

[56] References Cited

U.S. PATENT DOCUMENTS

| | | | |
|---|---|---|---|
| 340,263 | 4/1886 | Weber | 256/68 |
| 1,822,389 | 9/1931 | Blakely | 403/199 |
| 3,428,300 | 2/1969 | Sconzo | 256/59 |

*Primary Examiner*—Wayne L. Shedd
*Attorney, Agent, or Firm*—Walter P. Wood

[57] ABSTRACT

A one-piece stamped metal fence post cap aligns and attaches the top rail of a fence. The cap enables the top rail to extend at a range of vertical angles with respect to the post, depending on the terrain. It covers the ragged, exposed end of the post. It can be formed from precoated metal or can be easily coated after fabrication.

7 Claims, 5 Drawing Figures

STAMPED METAL FENCE POST CAP

BACKGROUND OF THE INVENTION

This invention relates to a device for attaching the top rail of a fence to the fence posts and in proper alignment with the posts. More particularly, the invention relates to a one-piece stamped metal fence post cap.

In the construction of wire fabric fences, it is necessary to attach the top rail of the fence to the fence post in order to form a rigid frame for the wire fabric. Additionally, the post and the rail are not always perpendicular to each other because of variations in terrain. The conventional method of attaching the top rail to the post is through the use of a fence post cap.

Conventional fence post caps are either cast metal pieces or fabricated metal pieces that are assembled and welded. These methods of manufacturing caps are expensive and slow. In addition, galvanizing or other such coatings may not be practical where the pieces are to be welded together after coating.

It is therefore an object of this invention to provide a fence post cap which is of a one-piece construction and which allows for coating before, as well as after, forming.

Still another object of this invention is to provide a fence post cap with the capability of attaching the top rail of the fence at a range of vertical angles with respect to the fence post, depending on the terrain.

These and other objects will become apparent through the following description of the invention.

DESCRIPTION OF THE PREFERRED EMBODIMENT

Figure 5:
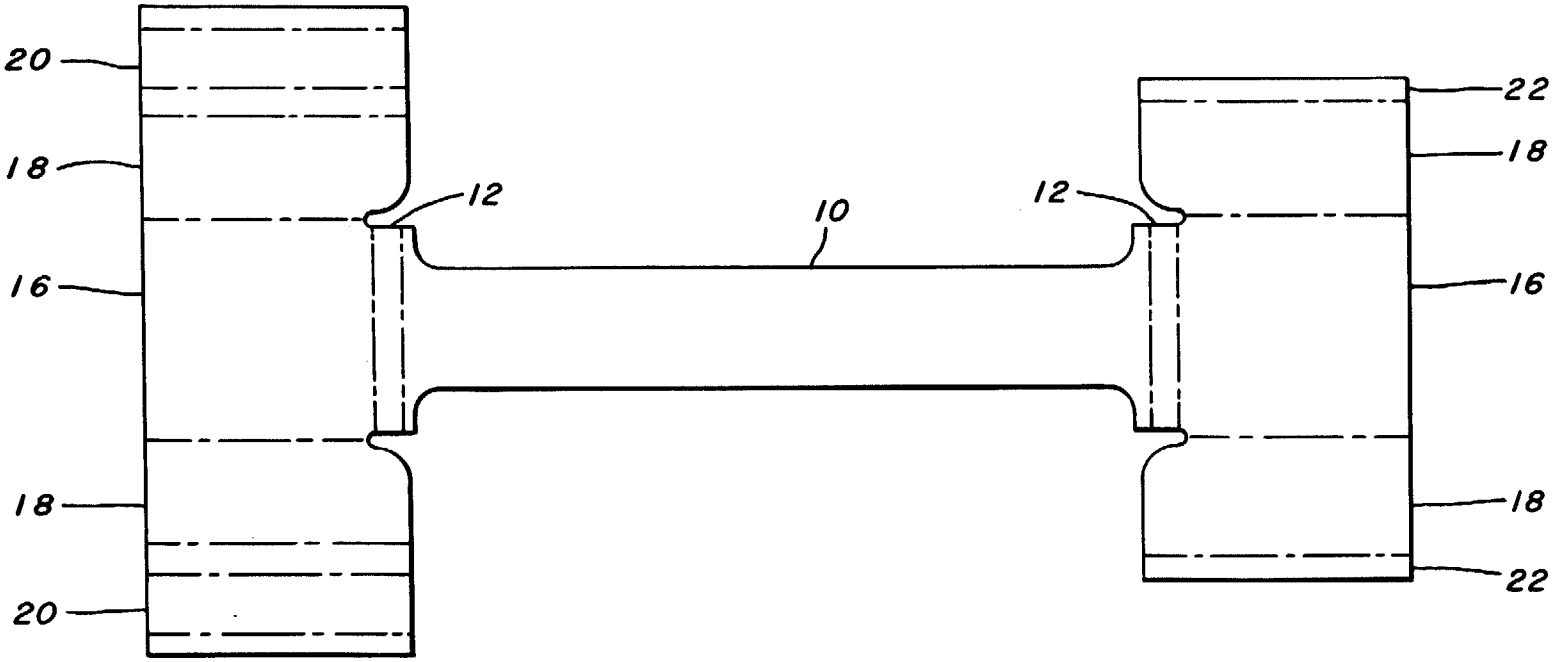
FIG. 5 is a plan view of the blank from which the cap is stamped.

As shown in FIG. 5, the cap is formed from an integral flat sheet metal blank which includes a narrow rectangular body 10 and slightly wider ledge portions 12 extending from the ends thereof. Side wall portions 16 extend from the ledge 12. Wall segment portions 18 extend from opposite edges of the portions 16. Outer joint segments 20 and mating inner joint segments 22 extend from wall segments 18.

Figure 1:
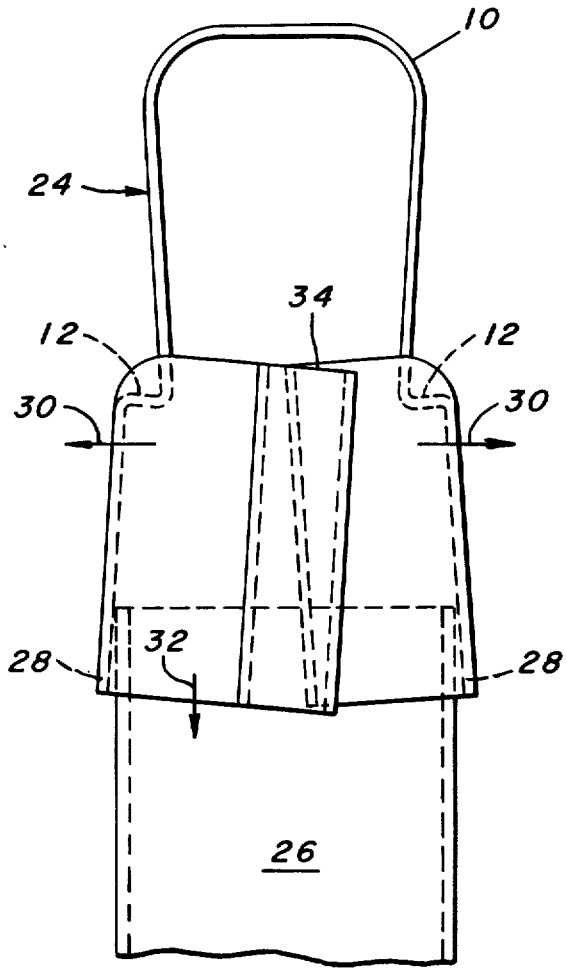
FIG. 1 is a front elevation of the cap installed on a post.
Figure 3:
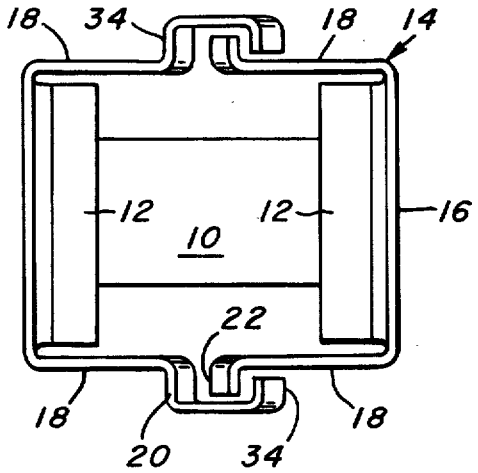
FIG. 3 is a bottom plan view.

The stamping operation bends the outer and inner joint segments 20 and 22, respectively, of the wall segments 18. Then, the wall segments are bent to conform to the cross section of the post upon which the cap is to be placed, which can be square, elliptical, or circular. For purposes of illustration, the embodiment shown in the figures is for a post of square cross section. In FIG. 3, the wall segments 18 are shown bent at right angles to the side walls 16. The side walls 16 are then bent at right angles to the ledges 12. The post-receiving receptacle 14 is now formed. The next bends are made between the body portion 10 and the ledges 12. These bends should be opposite to those between the ledges and side walls and at an angle slightly less than 90°. FIG. 1 shows an angle of 82° in the preferred embodiment. Finally the loop is formed from body 10 and the joint segments are mated.

Figure 4:
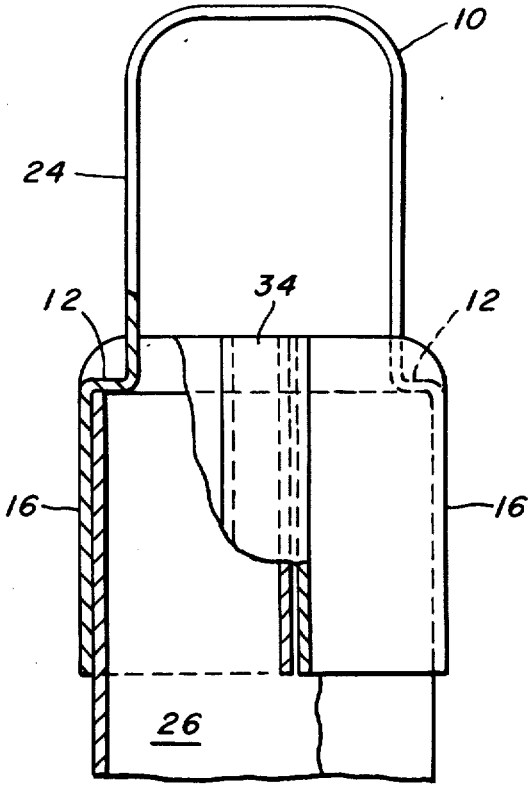
FIG. 4 is a partial section of the cap as installed on a post.

The springing action of the loop 10 keeps the joint segments apart unitl the cap is installed on a post at which time the side joints 34 are interlocked, as seen in FIG. 4 and the cap is frictionally clamped to the post. The side joints when apart have sufficient space to facilitate coating the cap, such as galvanizing or painting, after stamping and before it is used (FIG. 3).

Figure 2:
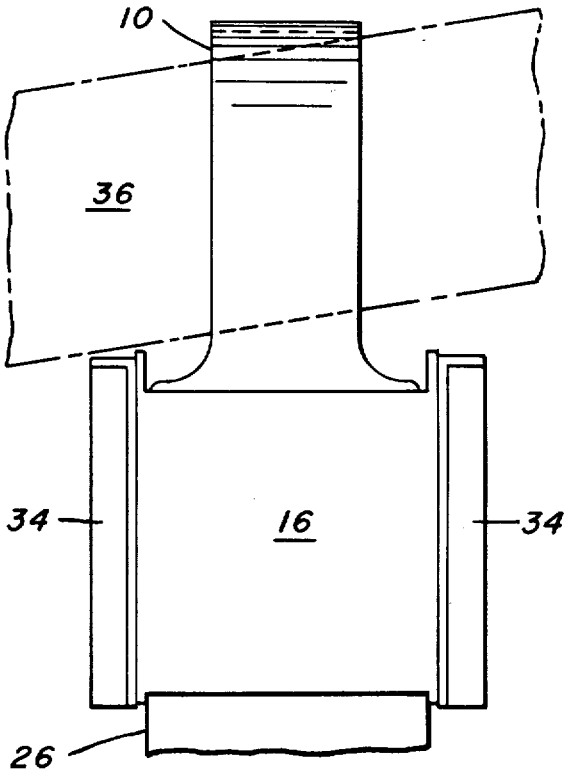
FIG. 2 is a side elevation view of the cap with a top rail in phantom lines dipicting a possible angle of alignment.

As seen in FIG. 2, the width of the loop 10 is less than the width of the side wall 16 which enables a top rail 36 to extend at a range of vertical angles with respect to the post. The rail is shown installed in the cap at a maximum angle with the post in FIG. 2.

FIG. 1 shows the cap 24 in its starting position as it is placed on the post 26. As the cap is placed on the post the inside walls at 28 first come in contact with the post. The cap is shaped so that the post causes the cap to spread in direction 30 as the cap is moved in direction 32 relative to the post. When ledge 12 is reached by the post, the cap 24 is spread as far as possible and the side joints 34 are locked together. Thus, a friction fit results between post 26 and cap 24. The end of the post which may have become ragged from being pounded into the ground is now covered by the ledge 12.

From the foregoing, it is seen that the invention described affords a fence post cap which is formed of a simple one-piece metal stamping that is economical to manufacture and may be procoated before fabrication.

Many modifications, additions, or deletions may, of course, be made to the illustrated embodiment without departure from the spirit and scope of the invention as set forth in the following claims.

I claim:

1. A cap for attaching a rail to the top of a fence post, said cap being formed from an integral, one-piece, flat, springy blank, said blank having a narrow rectangular body portion, wider ledge portions extending from the ends thereof, wall portions extending from the ends of said ledge portions, and mating joint segments extending from said wall portions, said cap comprising:

a rail receiving loop formed by bending said narrow rectangular body portion so that said ledge portions are brought substantially together;

a pair of ledges formed by outwardly bending said ledge portions of said blank;

post-receiving means depending from said ledges formed from said wall portions; and interlocking side joints in said post-receiving means, said side joints formed from said mating joint segments and interlocking as said cap is thrust onto said fence post, said loop having a spring action tending to push said wall portions together for frictionally clamping said cap to said post.

2. A cap as described in claim 1 wherein said post-receiving means includes side walls depending from said ledges, and wall segments extending from said side walls, and in which said interlocking joints extend from the edges of said wall segments.

3. The combination of a post, a rail, and a cap attaching said rail to said post, said cap constructed as defined in claim 1.

4. A cap as described in claim 2 wherein said post receiving receptacle is square in cross-section.

5. A cap for attaching a rail to the top of a fence post, said cap comprising:

a springy rail receiving loop in its upper portion;

a pair of ledges extending from the lower edges of said loop;

post receiving means depending from said ledges; and interlocking side joints in said post receiving means frictionally clamping said cap to said post.

6. A cap as described in claim 5, wherein said post receiving means is a receptacle formed of side walls; and wall segments extending from said side walls;

said interlocking joints extending from the edges of said wall segments.

7. A cap as described in claim 6 wherein said receptacle is square in cross-section.

* * * * *